United States Patent [19]

Becker

[11] 4,201,181

[45] May 6, 1980

[54] TRAP LOADER SAFETY ASSEMBLY

[76] Inventor: Ormonde C. Becker, 404 E. Lake Dr., Sarasota, Fla. 33582

[21] Appl. No.: 932,275

[22] Filed: Aug. 9, 1978

[51] Int. Cl.[2] ..... F41B 7/00

[52] U.S. Cl. ..... 124/6; 124/40; 340/667

[58] Field of Search ..... 340/666, 667, 679, 680; 273/26 D; 124/8, 9, 32; 116/4

[56] References Cited

U.S. PATENT DOCUMENTS

| | | | |
|---|---|---|---|
| 1,229,092 | 6/1917 | Kimble | 124/8 |
| 1,817,786 | 8/1931 | Van Antwerp | 124/32 X |
| 3,659,576 | 5/1972 | Eade et al. | 273/26 D |
| 3,808,592 | 4/1974 | Wright | 340/667 X |

*Primary Examiner*—William R. Browne

*Attorney, Agent, or Firm*—Stein & Frijouf

[57] ABSTRACT

A trap loader safety assembly includes a trap target throwing machine positioned in a suitable pit having a predetermined safe position for a person loading the machine with targets. Normally the loader displays a red flag to the shooters before leaving the pit, but often this precaution is forgotten and the loader leaves the pit with no warning to the shooters. To overcome this possible danger, a seat which is normally provided for the loader, is responsive to the weight of the loader to place the throwing machine in operation and to discontinue a signal to the shooter or shooters to withhold shooting. When the loaders weight is removed from the seat the throwing machine is rendered inoperative and the signal is displayed to the shooter to withhold shooting.

7 Claims, 4 Drawing Figures

TRAP LOADER SAFETY ASSEMBLY

This invention relates to a trap loader safety assembly and, more particularly, to such an assembly in which the weight of the loader resting on a seat renders a throwing machine operative and discontinues a no shooting signal to the shooter.

BACKGROUND OF THE INVENTION

It is common practice in trap shooting for the throwing machine loader to display a flag signaling the shooter or shooters that the loader is about to leave the target throwing pit in front of the shooters. However, the loader may forget to display the flag, which has resulted in the loader being shot. While some older patents show target throwing machines which are inherently rendered inoperative for throwing a target when the loader leaves the normal position at the machine, a suitable signal is not provided to the shooters not to shoot under these circumstances.

The following U.S. Patents are of passing interest: Nos. 624,044; 791,776; 792,824; and 1,229,092. These patents all require that the loader be at the throwing machine for the machine to operate properly, but they do not assure that the machine will not function if the loader is out of his assigned position, nor do they provide a signal to the shooters that the loader has left his assigned position.

THE INVENTION IN BRIEF

The invention is directed to a trap target throwing safety assembly in which an electrically operated target throwing machine is connected with a control system which takes the machine out of circuit and causes a signal to be displayed to the shooters when a loader attendant at the machine leaves a predetermined safe position adjacent the machine. The system also provides a signal within the pit to alert the loader that he has left his designated position. The control system renders the throwing machine operative for throwing targets responsive to remote control away from the pit and proximate the shooters, and discontinues a signal to the shooters not to shoot, when the weight of the loader is positioned on a seat at the predetermined safe position proximate the machine. When the loaders weight is removed from the seat, the machine is rendered inoperative and the signal not to shoot is displayed to the shooters, and similarly provides the signal within the pit for the loader. The signals may be of any desired type, and herein are illustrated as lights which are illuminated to indicate that the loader is out of his safe position in the pit.

The invention is, in brief, directed to a trap target throwing safety assembly in which a traget throwing machine is electrically operated and is normally in operating circuit with a source of electric power to operate the machine, the machine being manually loaded by a loader operator positioned in a safe position proximate the machine. A signal system is provided for indicating whether or not the loader is in the safe position, to warn the shooters not to shoot when the loader is out of the safe position. A control system is provided for placing the throwing machine in it operating circuit and eliminating the signal system when the loader is in the safe position, and for taking the throwing machine out of the operating circuit and operating the signal system to indicate that the loader is out of the safe position. The control system is operated responsive to an operating system responding to the weight of the loader on a seat in the safe position to place the throwing machine in operation and to remove the signal system from operation; and upon the loaders' weight being removed from the seat to operate the control system to deactivate the machine and to initiate operation of the signal system.

It is a primary object of this invention to provide a new and useful trap target throwing safety assembly.

Another object is provision of a new and useful trap target throwing safety assembly including a target throwing machine electrically operated and normally in operating circuit with a source of electric power to operate the machine, the machine being manually loaded by a loader operator positioned in a safe position proximate the machine. A signal system is operable between first and second conditions for indicating when the loader is, respectively, in and out of the safe position. A control system is operable between a first condition for placing the machine in the operating circuit and placing the signal system in its first condition indicated the loader is in the safe position. A second condition takes the machine out of the operating circuit and places the signal system in its second condition indicating the loader is out of the safe position. An operating system operable to a first condition responsive to the loader being in the safe position for operating the control system is to its first position, and operable to a second condition responsive to the loader being out of the safe position to change the control system to its second condition. Related objects include the machine having an electric connector for connection with the power source with the control system being connected with the power source and receiving the connector in circuit with the power source. The operating system changes to its first condition responsive to the weight of the loader in the safe position. The operating system includes a seat for the loader with the seat being depressed responsive to the weight of the loader sitting thereon, to operate the operating system to its first condition. The operating system changes to its second condition when the weight of the loader is removed from the seat. A connector is connected with a suitable electrical outlet when the machine is operated without the safety assembly. When the machine is in the safety assembly the connector is removed from the outlet and connected with the control system as aforesaid. The seat is hinged along one side and spring supported along an opposite side to a raised position when the weight of the loader is on the seat. The seat is depressed against the spring force to place the control system in its first condition. The signal system includes a light directed toward a shooter remote from the assembly which is illuminated when the signal system is in its second condition. The signal system includes a second light located proximate the safe position and illuminated concurrently with the first mentioned light for indicating to the loader that he is out of the safe position.

These and other objects and advantages of the inventionwill be apparent from the following description and the accompaning drawing.

DESCRIPTION OF THE ILLUSTRATED EMBODIMENT

Figure 1:
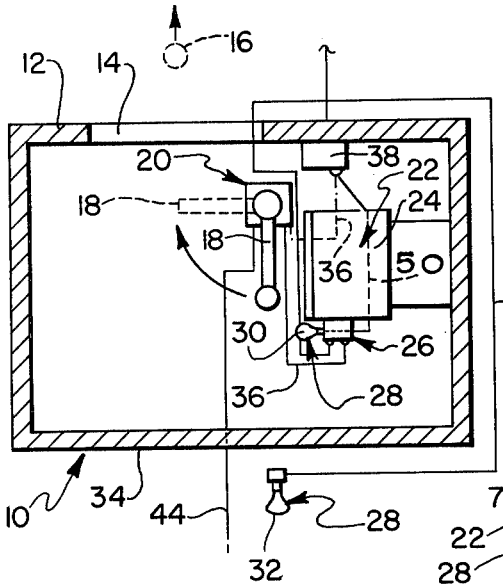
FIG. 1 is a schematic plan view of a trap loading pit, with the roof of the pit broken away and removed for clearer illustration.

Referring first to FIG. 1 of the drawing, a trap loader pit 10 is illustrated with its roof broken away and removed for clearer viewing of the interior of the pit 10. A front wall 12 has an opening 14 for passage of the operator or loader person (not shown), and for passage of the typical clay trap targets, as 16 shown in phantom lines after having been thrown through the opening 14. Targets, as 16, are individually thrown by a swinging arm 18 of a trap target throwing machine 20 which is operatively fixed to the floor of the pit. The loader must sit on a seat 22 (see FIGS. 2 & 3) which is in a safe position in the pit 10 to protect the loader from injury from the swinging arm 16. As will be more fully described later, the top 24 of the seat 22 is slightly depressed by the weight of the loader sitting thereon, and provides for operation of a control system 26 (FIG. 4) which supplies electric power to operate the machine 20 when the seat top 24 is depressed. When the top 24 is in its normal elevated position, the machine 10 is de-energized and causes a signal system 28 to be actuated. Signal system 28 may be of any suitable type and as illustrated includes a pair of light bulbs, one of the bulbs 30 is within the pit 10 to alert the loader when he has moved off of the seat 22. The other bulb 32 is preferably a flood light bulb mounted adjacent the exterior of a rear wall 34 of the pit 10, and is directed toward the shooters to alert them not to shoot when the light is on.

The throwing machine 20 may be of any suitable type, and such machines are generally electically operated with electric power supplied through electric wires 36, shown in phantom lines 36 in FIG. 1 connected by a male plug with a female electric socket in a box 38 on the front wall 12 of the pit 10. When in the safety assembly of this invention, the wires 36 are connected through their male plug with a power supply female electric socket 40 (FIG. 2) of the control system 26, the socket 40 being de-energized when the seat top 24 is in its elevated position. Throwing machines of this type are generally automatically programmed so that the target, as 16, is thrown by the arm 18 at an azimuth and elevation unknown to the shooter before the target is thrown. The throwing machine 20 is operated remotely by an attendant near the shooters' firing line, the attendant operating a switch 42 (FIG. 4) in circuit with wires 44 from the machine 20.

Figure 2:
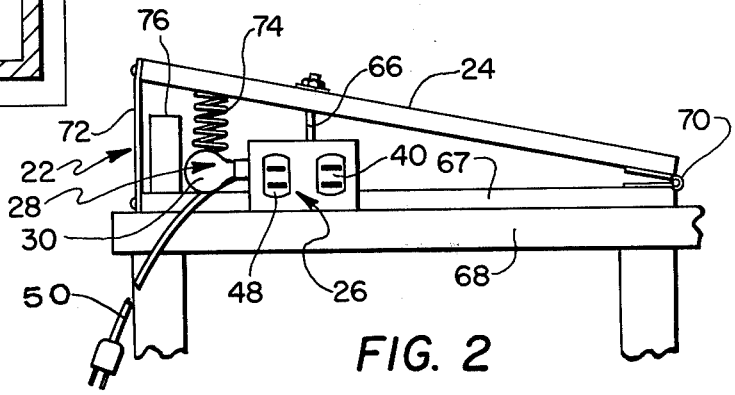
FIG. 2 is a schematic, enlarged, fragmentary side view of a seat in the pit shown in FIG. 1.
Figure 4:
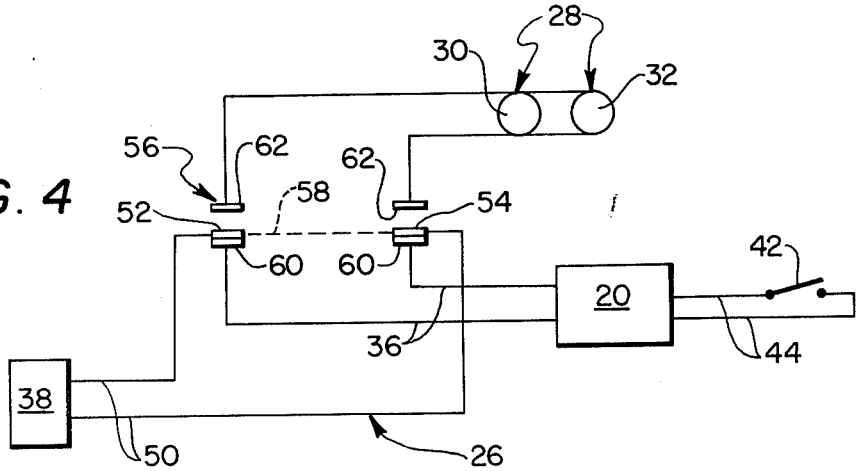
FIG. 4 is a diagram of an electric circuit of the invention.

The signal system 28 includes the light bulb 30 within the pit 10 for reminding the loader that he is not on the seat 22, and also includes the flood light bulb 32 outside the rear wall 34 of the pit 20 and facing the shooters to alert them not to shoot. The two bulbs 30 & 32 are connected in parallel (FIG. 4). Outside bulb 32 is connected by wires 46 and a male electric plug at their free end with the plug being received by a female electric socket 48 of the control system 26 as seen in FIG. 2. Other suitable signal devices, other than the bulbs may be used, as desired.

Figure 3:
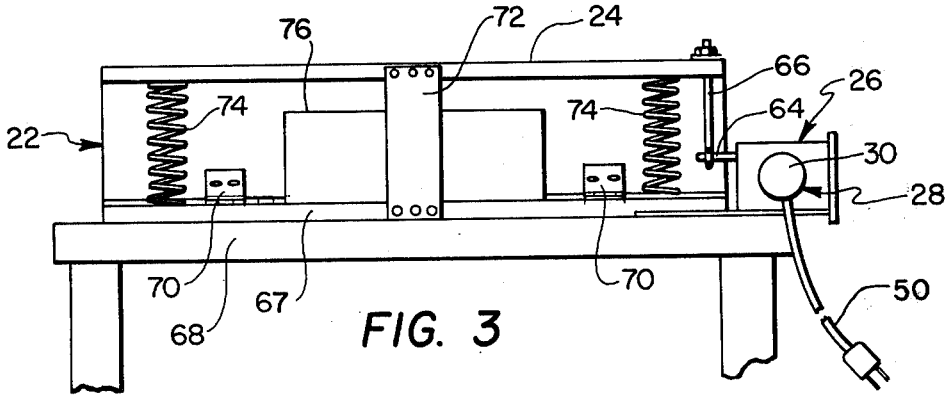
FIG. 3 is a schematic, fragmentary front view of the seat shown in FIG. 2.

The control system 26 is shown in diagram form in FIG. 4. Electric power supply wires 50 extend, one from each of the movable contacts 52 and 54 of a double throw double pole toggle switch 56 to a male electric plug which is received by the female electric socket in the power supply box 38. Contacts 52 and 54 are insulated from each other by a suitable member 58 indicated by dashed lines in FIG. 4. As seen in FIG. 4, the movable contacts 52 and 54 are closed against contacts 60 which, through the female electric socket 48 (FIG. 2), are connected in circuit with the power supply wires 36 of the throwing machine 10. This is the condition of the control circuit when the seat top 24 is depressed by the weight of the loader sitting thereon. When the loader gets up from the seat 22, the seat top 24 elevates automatically and causes the movable contacts 52 and 54 to open from fixed contacts 60 and to close with opposite fixed contacts 62 of the toggle switch. Contacts 62 are in circuit with the signal system bulbs 30 and 32, and upon closing with movable contacts 52 and 54 the bulbs are illuminated. The insulated member 58 which connects the movable contacts 52 and 54 carries a switch actuator in the form of a fixed stud 64 (FIG. 3). Stud 64 is freely received by an eye of a bolt 67 fixed to and depending from the bottom face of the seat top 24, to move the stud 64 up and down responsive to the seat top 24 being moved up and down, thereby operating the movable contacts 52 between the fixed contacts 60 and 62.

The seat 22 serves for operating the safety system. When the seat top 24 is in its elevated position the signal system is activated and the throwing machine is deactivated. When the seat top 24 is depressed, by the weight of the loader sitting thereon, the machine 20 is rendered operative and the signal system is rendered inoperative, as previously discussed. Seat 22 has a bottom plate 67 which is preferably operatively fixed to the usual loaders' bench 68 found in the pits 10. Rear sides of the bottom plate 67 and the seat top 24 are connected by hinges 70, and front sides of the plate 67 and the top 24 are connected by a flexible member 72, such as leather, for example, to limit upward movement of the seat top 24 responsive to the spring force of compression springs 74 seated on the plate 67 and the seat top 24. Downward movement of the seat top 24 is limited by a block 76 fixed to the upper face of the plate 67 at the front of the seat 22 and is spaced about an inch below the lower face of the seat top 24 when in its elevated position, and receives the bottom face of the top 24 as the top is depressed by the weight of the loader.

In summary, when the loader sits on the seat 22 its top 24 is depressed against the block 76 and the eye bolt 66 on the seat top 24 depresses the switch actuator stud 64, closing the movable switch contacts 52 and 54 against the fixed pair of contacts 60. This energizes the throwing machine 20 through the wires 36, and the machine may now be operated by the attendent upon closing the switch 42 on the "pull cord" wires 44, in usual manner. When the loader gets up from the seat 22, the eye bolt 66 on the seat top 24 elevates the switch actuator stud 64 and the movable contacts 52 move from the pair of fixed contacts 60 and close with the other pair of fixed contacts 62. This takes the throwing machine out of circuit and illuminates the bulbs 30 and 32, and deactivates the machine 20.

While this invention has been described and illustrated with reference to a particular embodiment in a particular enviroment, various changes may be apparent to one skilled in the art and the invention is therefore not to be limited to such embodiment or environment, except as set forth in the appended claims.

What is claimed is:

1. The combination of a trap target throwing machine and a safety assembly therefor, said target throwing machine being electrically operated and normally in operating circuit with a source of electric power to operate the machine, said machine being manually loaded by a loader operator positioned in a safe position proximate the machine and having means to throw a target; signal means operable between first and second conditions for indicating to a person when the loader is, respectively, in and out of said safe position; circuit control means operable between a first condition for placing said machine in an operating mode in said operating circuit and placing said signal means in said first condition indicating to the shooter and loader that the loader is in said safe position, and a second condition taking said machine out of said operating circuit and placing said signal means in said second condition indicating to a remote shooter and the loader that the loader is out of said safe position; and operating means operable to a first condition and responsive to the body or gravity weight of the loader indicating that the loader is in said safe position for operating said control means to said first condition and operable to a second condition and operable in response to the removal of the body weight of the loader indicating to a remote shooter and the loader that the loader is out of said safe position to operate said control means to said second condition.

2. A safety assembly as set forth in claim 1 in which said machine has an electric connector for connection with the power source, said control means includes means for connection with said power source to receive said connector in circuit with said power source.

3. A safety assembly as set forth in claim 2 in which said operating means is a seat for the loader, and said seat being depressed responsive to the weight of the loader sitting thereon to operate the operating means to said first condition, and to operate said operating means to said second condition when the weight is removed from the seat.

4. A safety assembly as set forth in claim 3 in which said seat is hinged along one side and is spring supported along an opposite side to a raised position when the weight of the loader is not on said seat, and upon the weight of the loader being on said seat, said seat is depressed against the spring force to place said control means in said first condition.

5. A safety assembly as set forth in claim 4 in which said signal means is a light directed toward a shooter remote from said assmebly for illumination when said signal means is in said second condition.

6. A safety assembly as set forth in claim 5 in which said signal means includes a second light located proximate said safe position and illuminated concurrently with the first said light for indicating to the loader that the loader is out of said safe position.

7. A safety assembly as set forth in claim 1 in which said operating means is a seat for the loader, and said seat being depressed responsive to the weight of the loader sitting thereon to operate the operating means to said first condition, and to operated said operating means to said second condition when the weight is removed from said seat.

* * * * *

UNITED STATES PATENT AND TRADEMARK OFFICE

CERTIFICATE OF CORRECTION

PATENT NO. : 4,201,181
DATED : May 6, 1980
INVENTOR(S) : Ormonde C. Becker

It is certified that error appears in the above-identified patent and that said Letters Patent are hereby corrected as shown below:

Column 3, line 56, delete "20" and insert --10--;

Column 5, line 2, delete "ing" and insert --ine--;

Column 6, line 19, delete "assmebly" and insert --assembly--.

Signed and Sealed this

*Twenty-sixth* Day of *August 1980*

[SEAL]

*Attest:*

SIDNEY A. DIAMOND

*Attesting Officer*

*Commissioner of Patents and Trademarks*